US009056517B2

(12) United States Patent
Qiao et al.

(10) Patent No.: US 9,056,517 B2
(45) **Date of Patent: *Jun. 16, 2015**

(54) POP UP GREETING CARDS

(75) Inventors: Tiger Qiao, Shanghai (CN); Johnathan Talbot, Bay Village, OH (US); Theresa Muri, Richfield, OH (US); David Mayer, Bay Village, OH (US); Jerry Guo, Shanghai (CN); Annie Deckerd, Elyria, OH (US); Gary Nelson, Avon, OH (US)

(73) Assignee: American Greetings Corporation, Cleveland, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/470,499

(22) Filed: May 14, 2012

(65) Prior Publication Data

US 2013/0232828 A1 Sep. 12, 2013

Related U.S. Application Data

(63) Continuation-in-part of application No. 12/974,287, filed on Dec. 21, 2010, now Pat. No. 8,322,058.

(60) Provisional application No. 61/485,298, filed on May 12, 2011.

(51) Int. Cl.

| | |
|---|---|
| ***G09F 1/00*** | (2006.01) |
| ***B42D 15/02*** | (2006.01) |
| *B42D 15/04* | (2006.01) |
| *B42D 25/20* | (2014.01) |

(52) U.S. Cl.

CPC ..... *B42D 15/022* (2013.01); *B42D 15/027* (2013.01); *B42D 15/045* (2013.01); *B42D 25/285* (2014.10)

(58) Field of Classification Search

CPC ..... B42D 15/022
USPC ..... 40/124.03, 124.06, 124.08
See application file for complete search history.

(56) References Cited

U.S. PATENT DOCUMENTS

| | | | | |
|---|---|---|---|---|
| 4,774,780 | A | 10/1988 | Crowell | |
| 5,055,084 | A * | 10/1991 | Jokic | 446/486 |
| 6,726,572 | B1 | 4/2004 | Versen | |
| 6,796,872 | B2 | 9/2004 | Herber | |
| 6,966,135 | B1 | 11/2005 | McDonald | |
| 7,008,289 | B2 | 3/2006 | Norman | |
| 7,552,553 | B2 | 6/2009 | Kelly | |
| 7,603,802 | B2 * | 10/2009 | Oudekerk et al. | 40/375 |
| 7,694,445 | B2 | 4/2010 | Kelly | |

(Continued)

FOREIGN PATENT DOCUMENTS

WO WO 2005/044413 5/2005

*Primary Examiner* — Kristina Junge
(74) *Attorney, Agent, or Firm* — Christine Flanagan

(57) ABSTRACT

An interactive electronic greeting card with pop up feature includes a three-sided pocket or cavity which houses various electronic and mechanical components and a pop up element. In a first position, the pop up element is substantially contained within the greeting card pocket or cavity. When the push button is depressed, the pop up element is ejected or "pops up" out of the greeting card pocket or cavity, revealing a greeting or other printed indicia. The push button also initiates playback of a pre-loaded digital audio file, which may be a spoken message, a sound, a song, music or other such audio recording. Manually pushing the pop up element back into the cavity ends playback of the audio.

13 Claims, 7 Drawing Sheets

(56) References Cited

U.S. PATENT DOCUMENTS

| | | | | |
|---|---|---|---|---|
| 7,707,757 | B2 * | 5/2010 | Crowell | 40/491 |
| 7,861,441 | B1 * | 1/2011 | Hoellwarth | 40/124.06 |
| 7,905,416 | B2 | 3/2011 | Halbur et al. | |
| 2007/0215694 | A1 | 9/2007 | Clegg | |
| 2007/0256337 | A1 * | 11/2007 | Segan | 40/124.03 |
| 2007/0284269 | A1 | 12/2007 | Star | |
| 2009/0176438 | A1 | 7/2009 | Meno | |
| 2009/0214802 | A1 * | 8/2009 | Sedlacko | 428/7 |
| 2009/0217559 | A1 * | 9/2009 | Sayre | 40/124.06 |
| 2009/0305604 | A1 | 12/2009 | Jemas | |
| 2010/0263243 | A2 * | 10/2010 | Sayre | 40/124.06 |
| 2011/0101090 | A1 | 5/2011 | Halbur et al. | |
| 2011/0126437 | A1 * | 6/2011 | Bullington | 40/124.06 |
| 2011/0146117 | A1 * | 6/2011 | Mayer et al. | 40/124.03 |
| 2012/0048766 | A1 * | 3/2012 | Glass et al. | 206/484 |

* cited by examiner

POP UP GREETING CARDS

RELATED APPLICATIONS

This application claims priority to U.S. Provisional Patent Application No. 61/485,298 filed on May 12, 2011 and also to U.S. patent application Ser. No. 12/974,287, filed on Dec. 21, 2010. Copies of the above-referenced patent documents are incorporated herein by reference in their entirety.

FIELD OF THE INVENTION

The present invention is in the field of social expression and entertainment products, and more specifically to greeting cards with mechanical and electronic functions and features.

BACKGROUND OF THE INVENTION

Traditional paper greeting cards have been widely used for celebratory occasions such as birthdays, graduations, weddings, and for other commercial purposes. More recently, the market has expanded with greeting cards that attempt to capture attention by alternate designs and other features to enhance the communicative and entertainment value of social and relational greetings. The widespread availability of compact digital electronics has made incorporation into social communication products economical. Although the prior art includes greeting cards with sound-generating features, such cards are generally available only in a fixed format wherein a sound file is played upon activation by manipulation of the card. Cards with mechanical or structural features such as three-dimensional "pop-ups" are conventionally made with multiple panels or pages which are attached at various locations to unfold in multiple planes. A particular challenge to incorporate mechanical movement in a greeting card is to do so without making the card too bulky or thick, so that it has the same general configuration and size as conventional flat panel cards.

SUMMARY OF THE INVENTION

An interactive electronic greeting card with pop up feature includes a pocket or cavity which houses various electronic and mechanical components and a pop-up element. In a first position, the pop-up element is substantially contained within the greeting card pocket or cavity. In a second position, the pop-up element is substantially outside the greeting card pocket or cavity. A push button controls movement of the pop-up element between the first and second positions. Pressing the push button causes the pop-up element to be ejected or to "pop up" out of the greeting card pocket or cavity, revealing a greeting or other printed indicia. The push button also initiates playback of a pre-loaded digital audio file, which may be a spoken message, a sound, a song, music or other such audio recording. Manually pushing the pop-up element back into the cavity ends playback of the audio.

DETAILED DESCRIPTION OF PREFERRED AND ALTERNATE EMBODIMENTS

The greeting card of the present invention combines a spring loaded pop-up element and sound capability with a greeting card having push button activation. The push button requires user interaction with the greeting card in order to reveal the pop-up element and to initiate playback of a pre-loaded digital sound file. The pop up element is retained inside a pocket or cavity of the greeting card and a spring loaded mechanism controls the movement of the pop-up element between a first position concealed within a pocket or cavity of the greeting card and a second position wherein a significant portion of the pop-up element is ejected from the pocket or cavity.

Figure 2:
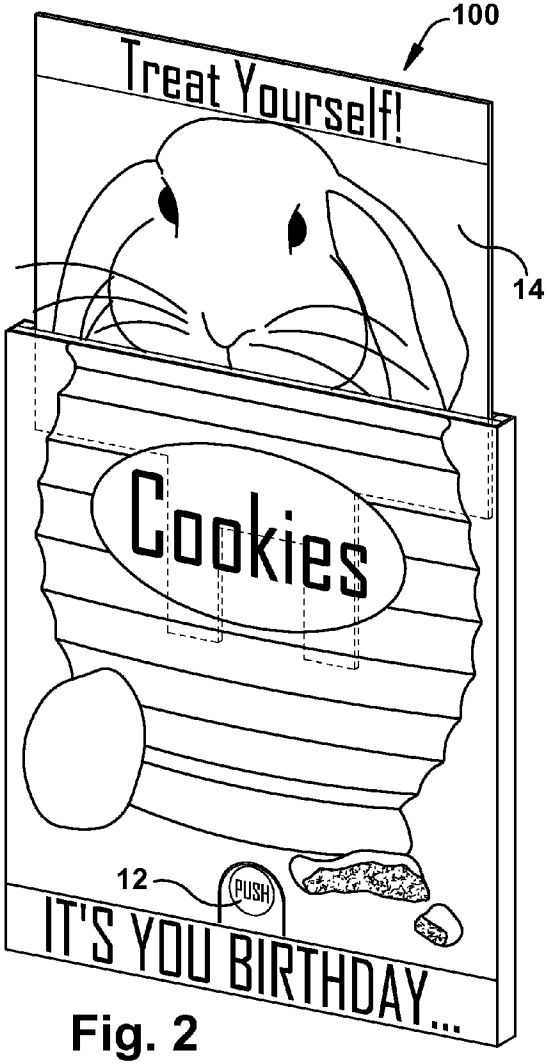
FIG. 2 is a perspective view of the Pop Up Greeting Card of FIG. 1, in a second position.
Figure 1:
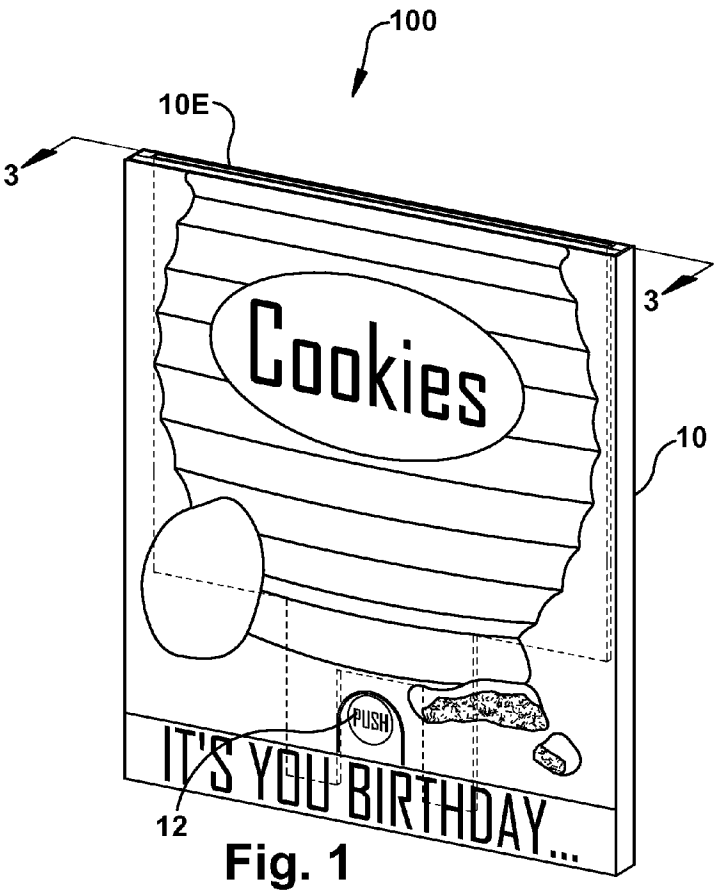
FIG. 1 is a perspective view of a first embodiment of the Pop Up Greeting Card of the present invention, in a first position.
Figure 3:
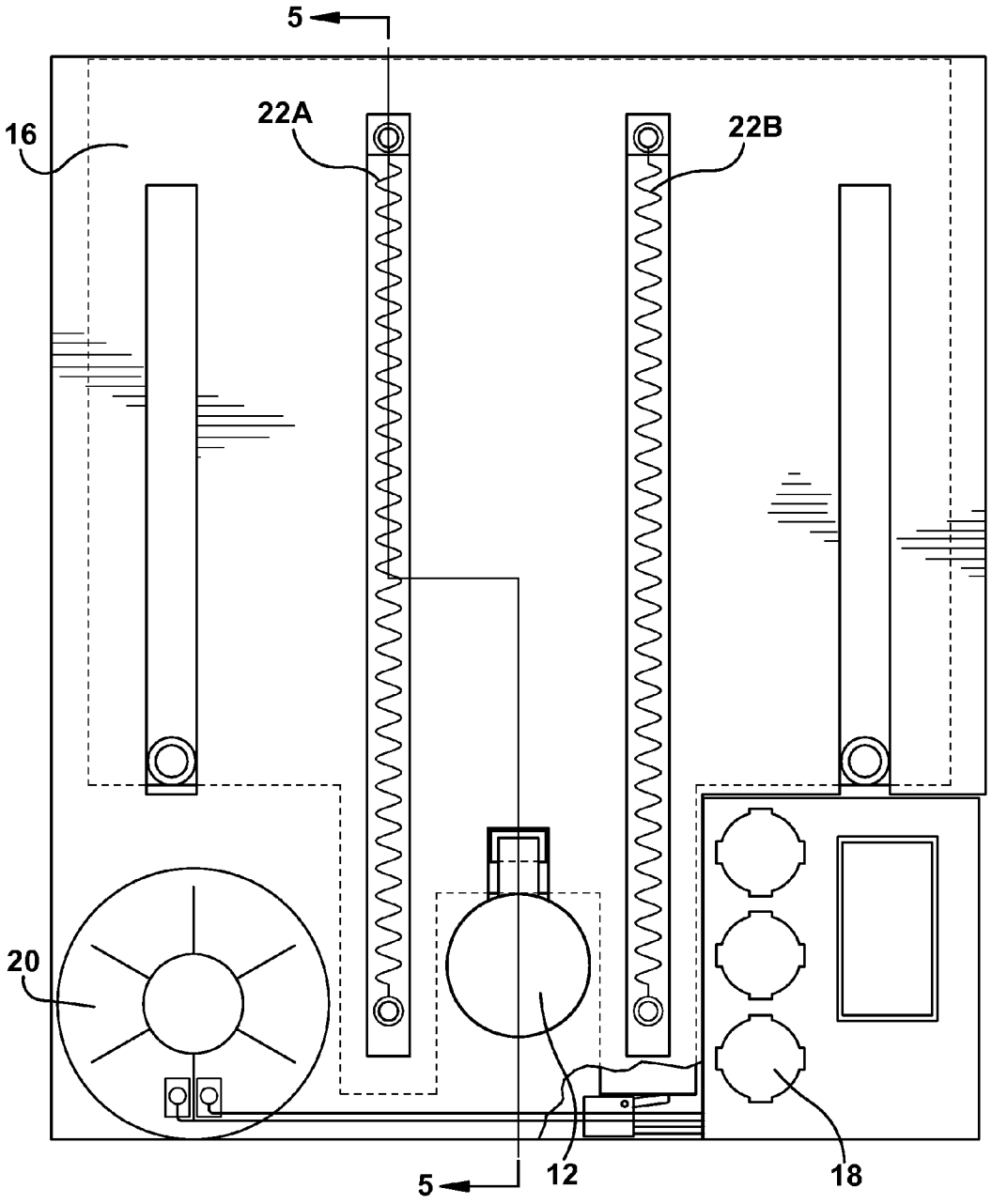
FIG. 3 is a front view of the internal components of the Pop Up Greeting Card of FIG. 1.
Figure 4:
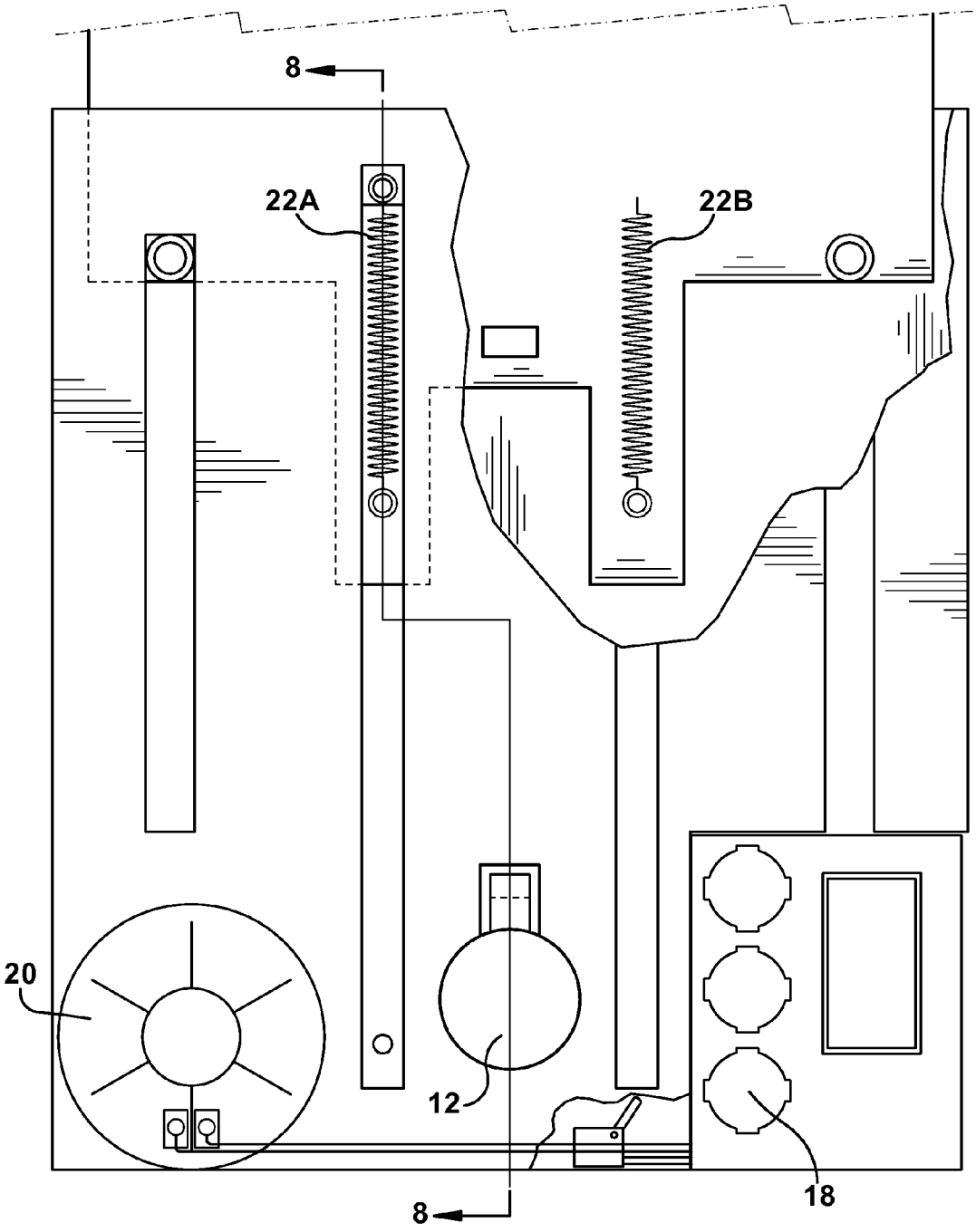
FIG. 4 is a front view of the internal components of the Pop Up Greeting Card of FIG. 2.
Figure 5:
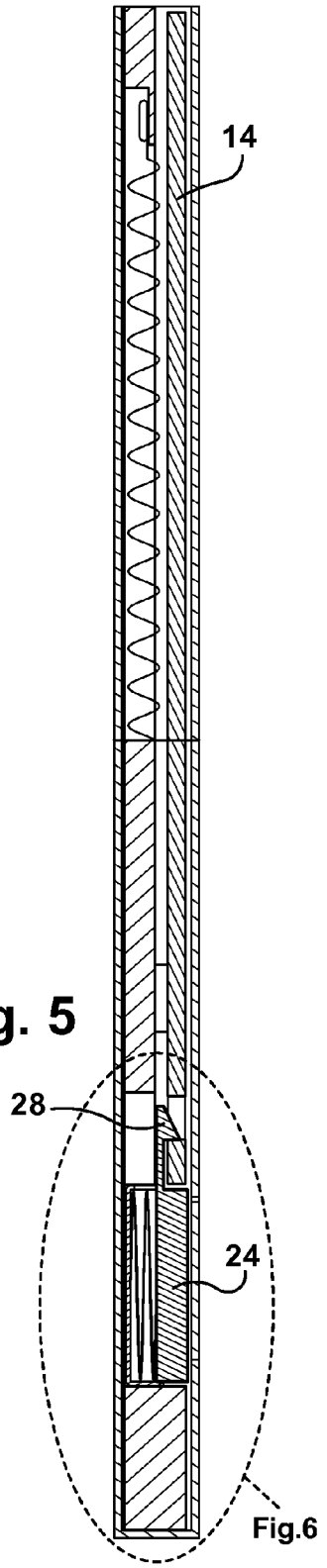
FIG. 5 is a cross-section of FIG. 3, viewed in the direction of arrows 5-5.
Figure 6:
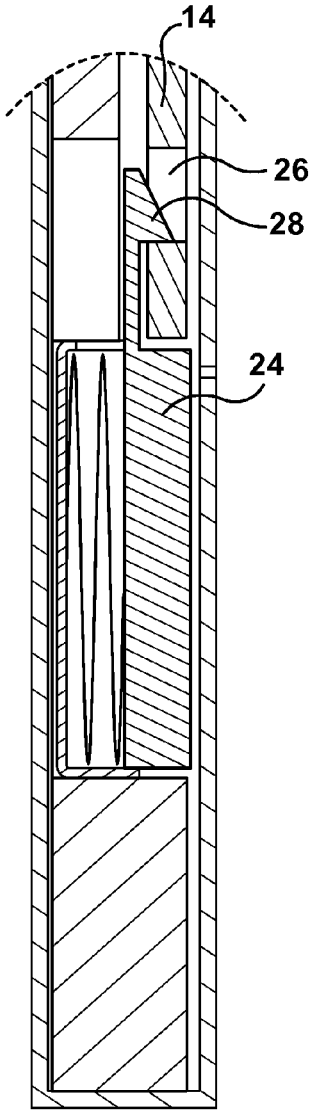
FIG. 6 is a close up view of a portion of FIG. 5.
Figure 7:
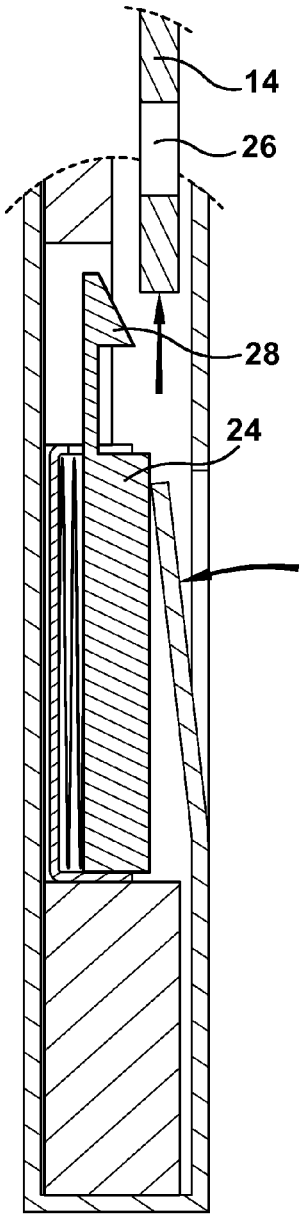
FIG. 7 is a close up view of a portion of FIG. 8.
Figure 8:
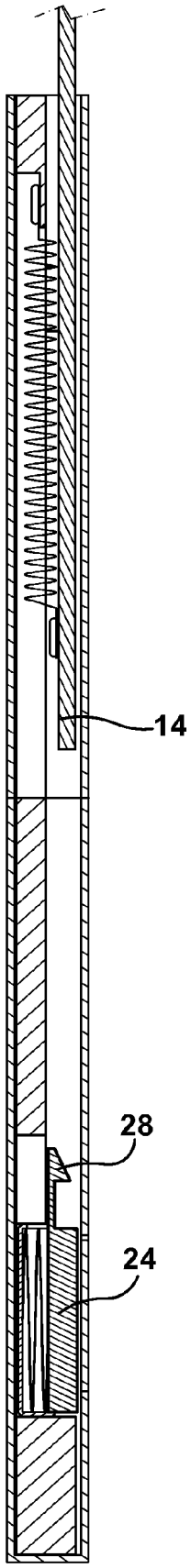
FIG. 8 is a cross-section of FIG. 4, viewed in the direction of arrows 8-8.

In one embodiment, shown in FIGS. 1 and 2, the greeting card body 10 has a front surface, a back surface parallel to and spaced apart from the front surface, and a right, left and bottom side wall which extend between the front and back surfaces of the greeting card 100, creating a three sided pocket or cavity contained therein. A top edge 10E of the greeting card 100 is opened to accommodate the insertion and retraction of a pop-up element 14. The pocket or cavity is created by the three sided enclosure which, in a preferred embodiment is made of paperboard or other strong but lightweight material. Inside the pocket or cavity is contained a protective cardboard frame 16 for housing or accommodating electronic components, a push button 12 and spring activation mechanism or other activation mechanism, and a pop-up element 14. For example, the frame 16 can be made from one or more pieces of paperboard with appropriate cut-outs or openings can be positioned between the front and back panels of the card to hold and secure the mechanical and electronic components of the card. The frame 16 contains a front panel and a back panel, both panels having various slots or openings strategically placed thereon to accommodate the various components of the greeting card 100. The front panel is parallel to and spaced apart from the back panel. In the space between the front and back panels are contained various components of the greeting card 100. In areas where no components are located, a piece of foam, cardboard, paperboard or other material may be used between the two panels to keep a consistent space between the panels. The electronic components may include a circuit board with integrated circuit and controller, memory storage device upon which at least one digital audio file is pre-loaded and saved, a power source, such as one or more batteries 18, a speaker 20, related circuitry and any other electronic component which may be required to store and replay one or more audio files, as are known to one of skill in the art. The pop-up element 14, in this particular embodiment, is a decorated panel having printed text, such as a birthday greeting and/or drawings or artwork contained thereon. The panel 14 is positioned between the front and back panels of the protective frame 16. The spring loaded mechanism includes two springs 22A, 22B which are attached at a first end to the bottom of the pop-up element or panel 14 and at a second end to an upper region of the protective frame 16. When the pop-up element 14 is in a first position substantially concealed within the greeting card, as shown in FIG. 1, the springs are compressed or stretched, as shown in FIG. 3. A push button mechanism is contained between the protective panels 16 and contains a push button 12 that is connected to a catch or an arm 24. The catch or arm 24 of the push button mechanism contains a lip 28 that extends outward in a forward direction. The pop-up element or inner panel 14 contains a small opening 26 thereon so that when the pop up element 14 is in a first position substantially concealed within the greeting card 100, i.e., between the front and back panels of the card and within or proximate to the frame, the lip 28 of the catch or arm 24 extends into the opening 26 on the pop-up element or inner panel 14, thereby retaining the panel 14 within the greeting card 100 with the springs 22A, 22B in a extended position, as shown in FIGS. 3, 5 and 6. When the push button 12 is depressed it moves the catch or arm 24 causing the lip to become disengaged with the opening 26 on the pop-up element 14 and releasing the compressed springs 22A, 22B, as shown in FIGS. 4, 7 and 8. The mechanical energy stored in the springs 22A, 22B when they are in a compressed state, propel or eject the pop-up element 14 upward through the opening along the upper edge 10E of the greeting card body 10. In addition to causing the pop-up element 14 to be revealed through the top of the greeting card 100, the press button 12 also initiates playback of the at least one pre-loaded audio file. The audio file may contain a spoken message, a song, music, various sounds, etc. When the pop-up element 14 is pushed back down and secured inside the greeting card 100, playback of the audio ends.

Figure 9:
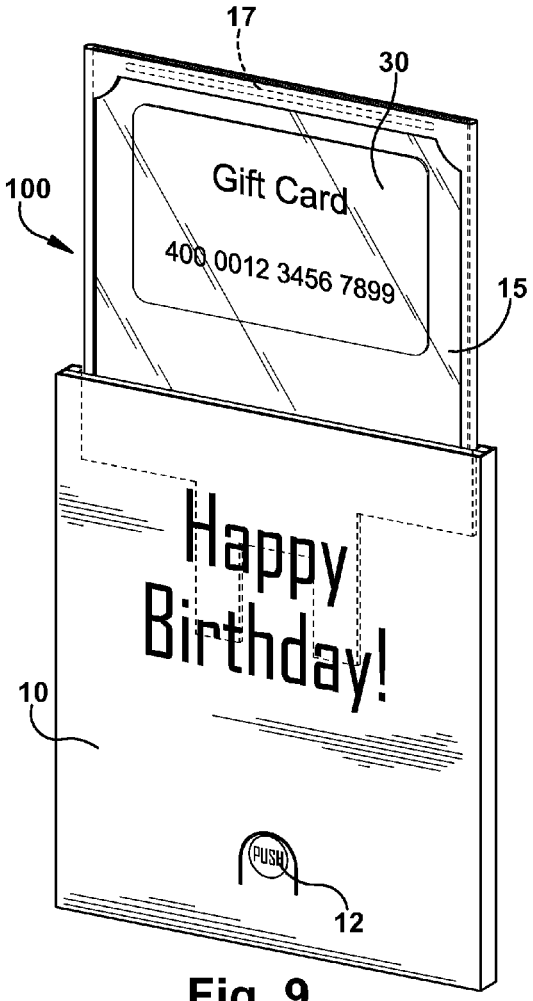
FIG. 9 is an alternate embodiment of the Pop Up Greeting Card of the present invention.
Figure 11:
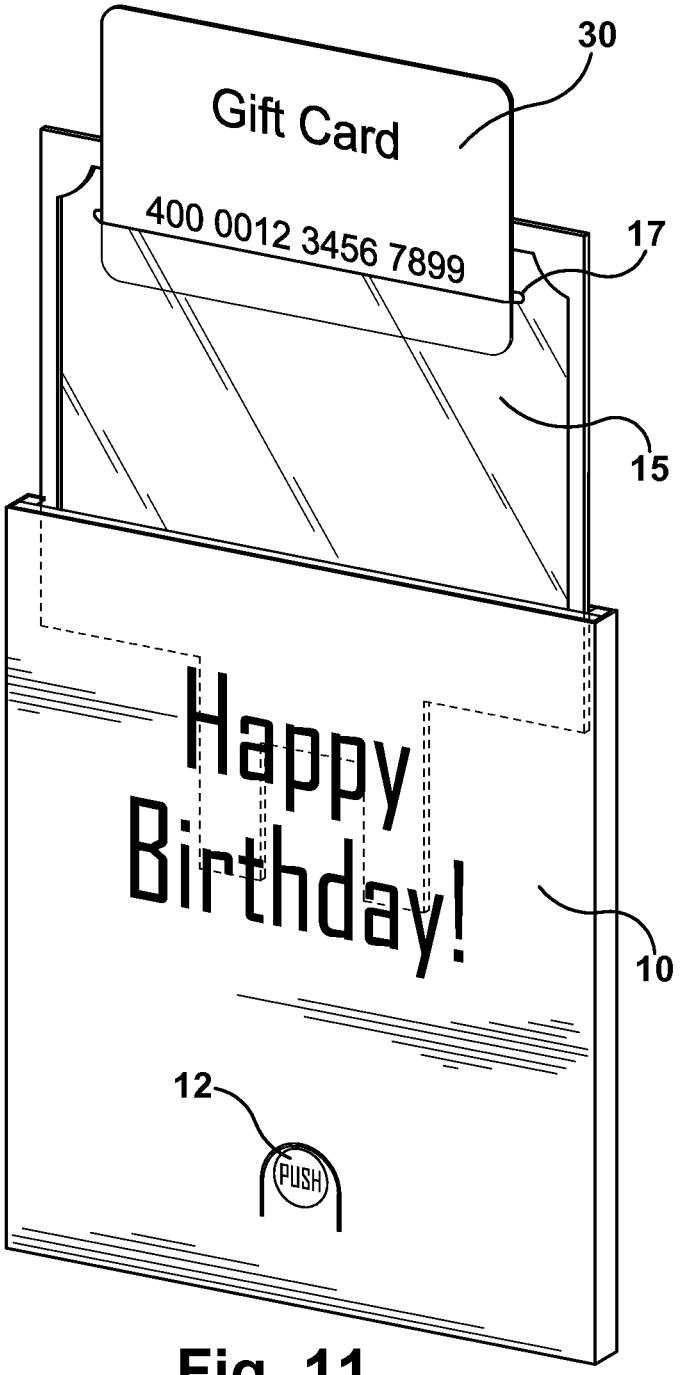
FIG. 11 is a perspective view of the Pop Up Greeting Card of FIG. 9 with a gift card partially removed from a cavity.

In an alternate embodiment, shown in FIGS. 9 and 11, the greeting card of the present invention includes a pop-up element 15 which serves as a pocket or cavity wherein a gift card 30 may be inserted for presentation to the greeting card recipient. The greeting card body 10 may include, as described above, a main pocket or cavity which contains a front side, a back side which is parallel and spaced apart from the front side, and a right, back and bottom side which extend between the front and back panels along three side edges, thereby creating a three-sided pocket. The top of the greeting card is open for inserting the pop-up element 15. The pop-up element 15 is in itself another pocket or cavity which is operative to contain a standard sized gift card 30. The pop-up cavity 15 may contain a front surface which contains an opening thereon through which the gift card 30 is visible, or the pop-up cavity 15 may contain a front surface which contains an opening thereon which is covered with acetate or other clear, transparent material, through which the gift card 30 is visible. Alternatively the entire pop-up cavity 15 may be made of acetate or other clear, transparent material. The pop-up cavity 15 may be closed on all sides to prevent accidental removal of the gift card, with a slot 17 or flap or tab removably attached along a top surface which can be used to open the cavity 15 and remove the gift card 30. The cavity 15 may also be a three-sided cavity with a completely open top edge for removal of the gift card 30. The pop-up cavity 15 is larger than the measurements of a standard gift card, which are approximately 5¼ inches high and 3⅝ inches wide. Alternatively, the pop-up element may be a single panel, as described above, with a gift card 30 removably attached thereto. The spring and push button mechanism described above, may be used to move the pop-up cavity 15 (with gift card 30 therein) between a first position wherein the pop-up cavity 15 is substantially concealed within the main greeting card pocket or cavity and a second position wherein the pop-up cavity 15 is substantially outside of the main greeting card pocket or cavity. The protective frame construct, also described above, may also be used in this embodiment to protect the various inner components of the greeting card 100. This embodiment may also include a sound module contained within the main pocket or cavity which is operative to store and playback at least one pre-recorded audio file.

Figure 10:
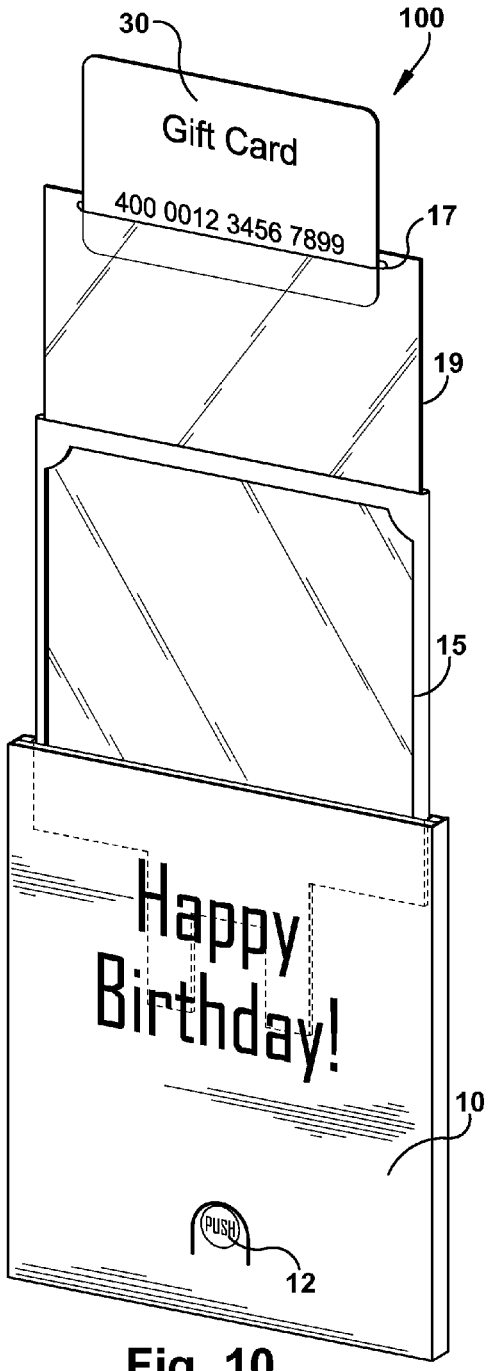
FIG. 10 is an alternate embodiment of the Pop Up Greeting Card of the present invention.

In still another embodiment, shown in FIG. 10 the greeting card 100 includes two or more telescoping pockets or panels 19 which telescope in an inward and outward direction with respect to one another. The smallest or innermost pocket may contain a gift card 30 therein or removably attached thereto. Alternately, the gift card 30 may be configured to fit within the smallest or innermost pocket 19 and it may be ejected from said pocket 19 upon pushing the press button 12. The first or main pocket or cavity 10 serves as the outer surface of the greeting card 100, as described above with reference to the other embodiments, and therefore is the largest of the pockets or panels of the greeting card 100. All of the other pockets or cavities 19 of the greeting card 100 are sized to fit within the first or main pocket 10 of the greeting card 100. After the first or main pocket 10, each successive pocket or cavity 19 is slightly smaller in size than the previous pocket or cavity such that each successive pocket or cavity 19 fits within the previous pocket. The main pocket or cavity 10, as described above, may have a front side, a back side parallel to and spaced apart from the front side and right, left and bottom sides which extend between the front and back panels along three side edges of the main panel or cavity. The spring and push button mechanism described above with respect to the other embodiments can be used to move the two or more inner pockets or cavities from a first position wherein the inner pockets or cavities are substantially contained and concealed within the main pocket or cavity and a second position, wherein the two or more inner pockets or cavities are substantially outside of the main pocket or cavity. The protective frame described above may also be used with this embodiment to protect the various internal components of the greeting card. This embodiment may also contain a sound module, as described above, which is operative to replay a pre-recorded audio file upon pressing the press button.

While the embodiments disclosed herein and shown in the figures have a generally square or rectangular shape, the greeting card may take on any conceivable die cut shape. The greeting card may also be made of alternate material such as plastic or foam. Also, the greeting card has been described and shown as having a press button which is operative to move the inner greeting card panel(s) from within a main pocket to outside the main pocket, however, any type of switch, such as a touch sensitive switch, a slide tongue switch, a light sensitive switch, a motion sensitive switch, a hand crank, a lever or any other mechanical or electromechanical device may be used. Also, the press button switch described herein controls both the movement of the inner panel(s) and also playback of an audio file, however, two separate switches may control the movement of the panel(s) and the playback of audio.

All of the embodiments described herein may additionally contain a USB port, SD card slot or other external memory device port for receiving or uploading audio files from an external source such as a personal computer. The greeting card embodiments disclosed herein may also contain a sentiment panel which is attached to a front or back surface or side of the main pocket or panel and serves as a traditional greeting card that is folded along a fold line and opened along said fold line to reveal a message, artwork, etc. Other additional features which have been contemplated are a microphone for recording a personalized user message for playback upon activation of the press button or other such switch; a motor module for mechanical movement of one or more movable elements which are attached in some way to the greeting card; and one or more LED lights which are visible through the front of the greeting card and which are illuminated upon pressing the press button or other such switch. Combination of the above-mentioned additional special effects or features have also been contemplated and are considered to be within the scope of the present invention.

The disclosure and related inventions thus provide novel card constructions and operations which can be constructed inexpensively and efficiently, and advantageously from primarily paperboard materials configured to securely hold mechanical and electronic components to enable a wide variety of functions and features which enhance the effectiveness of the card as a communication and entertainment device.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive. Other features and aspects of this invention will be appreciated by those skilled in the art upon reading and comprehending this disclosure. Such features, aspects, and expected variations and modifications of the reported results and examples are clearly within the scope of the invention where the invention is limited solely by the scope of the following claims.

What is claimed is:

1. A pop-up greeting card comprising:

a greeting card body having a front surface, a back surface parallel to and spaced apart from the front surface, and a right side wall, left side wall and bottom wall which each extend between the front surface and back surface creating a pocket therebetween;

a sound module having at least one digital audio file saved thereon;

a pop-up panel operative to move between a first position wherein it is substantially contained within the pocket and a second position wherein it is substantially outside of the pocket;

a spring mechanism attached to the pop-up panel, the spring mechanism comprising at least one spring;

a press-button having a lip attached thereto;

a lever which is operative to move from a first position wherein it interrupts a circuit providing power to the sound module and a second position wherein it completes the circuit;

wherein when the pop-up panel is in the first position, the lip attached to the press-button is engaged with an opening on the pop-up panel thereby retaining the pop-up panel within the pocket and pressing the press-button releases the lip from within the opening on the pop-up panel causing the pop-up panel to move into the second position wherein it is substantially outside of the pocket; and wherein when the pop-up panel is in the first position it forces the lever into the first position and wherein when the pop-up panel is in the second position it releases the lever causing said lever to move to the second position, thereby initiating playback of the at least one digital audio file; and wherein the spring mechanism does not allow the pop-up panel to be full removed from the greeting card.

2. The pop-up greeting card of claim 1, wherein the press-button is accessed through the front surface of the greeting card.

3. The pop-up greeting card of claim 1 further comprising a protective frame which is contained within the pocket.

4. The pop-up greeting card of claim 1, wherein manually pushing the pop-up panel into the pocket ends playback of the at least one digital audio file.

5. The pop-up greeting card of claim 1, wherein the pop-up panel contains a message printed thereon.

6. The pop-up greeting card of claim 1, wherein a gift card is removably attached to the pop-up panel.

7. A pop-up greeting card comprising:

a main pocket having a front side, a back side parallel to and spaced apart from the front side, and a right side, back side and bottom panel which extend between the front and back sides;

a coil spring loaded, three-sided pop-up panel which is contained within the main pocket;

a press-button having a lip contained thereon which engages with an opening in the pop-up panel to retain the pop-up panel inside the main pocket;

a sound module contained and concealed within the main pocket operative to store and playback at least one audio file contained therein;

wherein pressing the press-button disengages the lip from the opening in the pop-up panel causing the pop-up panel to spring outside of the main pocket and causes the sound module to play the at least one audio file.

8. The pop-up greeting card of claim 7, wherein the pop-up panel has a gift card attached thereto.

9. The pop-up greeting card of claim 7, wherein the pop-up panel contains a pocket therein.

10. The pop-up greeting card of claim 9, wherein the pocket in the pop-up panel contains a gift card therein.

11. The pop-up greeting card of claim 7, wherein the pop-up panel contains a greeting printed thereon.

12. The pop-up greeting card of claim 11, wherein the switch is accessed through the front side of the main pocket.

13. The pop-up greeting card of claim 7 wherein manually pushing the pop-up panel back into the main pocket causes playback of the at least one audio file to end.

* * * * *